United States Patent [19]

Hiranuma et al.

[11] Patent Number: 4,964,093

[45] Date of Patent: Oct. 16, 1990

[54] OPENING AND CLOSING STRUCTURE OF COVER LID OF WATCH

[75] Inventors: Haruki Hiranuma; Nobuhide Matsumoto, both of Tokyo, Japan

[73] Assignee: Seiko Instruments Inc., Japan

[21] Appl. No.: 493,516

[22] Filed: Mar. 16, 1990

[30] Foreign Application Priority Data

Mar. 15, 1989 [JP] Japan ..... 1-29225[U]
Mar. 28, 1989 [JP] Japan ..... 1-34989[U]

[51] Int. Cl.[5] ..... G04B 37/00
[52] U.S. Cl. ..... 368/283
[58] Field of Search ..... 368/276, 283, 286, 309–313

[56] References Cited

U.S. PATENT DOCUMENTS 2,636,338 4/1953 Dinstman ..... 368/283
2,679,785 6/1954 Ratt ..... 368/283
3,025,662 3/1962 Fleischman et al. ..... 368/283
3,584,455 6/1971 Sion ..... 368/283
4,444,513 4/1984 Proellochs et al. ..... 368/283

*Primary Examiner*—Vit W. Miska
*Attorney, Agent, or Firm*—Bruce L. Adams; Van C. Wilks

[57] ABSTRACT

In one form of the structure for preventing inadvertent opening of a cover lid of a water-proof watch, a protrusion formed on the cover lid is locked into a recess formed at a head of a lock button. A coil spring is attached to the lock button to bias the same to maintain the engagement between the recess of the lock button and the protrusion of the cover lid so as to prevent inadvertent opening or unlocking of the cover lid. In another form of the opening and closing mechanism of a cover lid, a rod member is provided with a water-tight sealing and a coil spring, and operates to apply a pressing force to a hinge portion of the cover lid to assist in closing of the cover lid, thereby realizing simplified water-tight structure of the opening and closing of the cover lid.

2 Claims, 3 Drawing Sheets

OPENING AND CLOSING STRUCTURE OF COVER LID OF WATCH

BACKGROUND OF THE INVENTION

The present invention relates to structure for preventing inadvertent opening of a cover lid of a waterproof watch which is used in hard condition where strong impact would be imposed due to exercise of wearer such as swimming of wearer. The present invention also relates to opening and closing structure of a cover lid of the watch.

FIG. 2 shows the conventional mechanism for opening and closing of a cover lid of a watch. A cover lid 7 is pressed downward in closing direction F' by means of biasing force F of a coil spring 9 engaged to a hinge 11 so as to prevent inadvertent opening of the cover lid 7.

However, in the FIG. 2 conventional opening and closing structure, the holding force F is effective to press down the cover lid 7 through the hinge 11 and this force F is solely caused by the coil spring 9. Therefore, the conventional structure is effective only against predectable impact force comparable to the biasing force. If external force exceeding the biasing force F of the coil spring 9 is applied to the watch, the conventional structure is ineffective to hold the cover lid 7 so that the cover lid 7 would be released.

On the other hand, the biasing force F of the coil spring 9 could be boosted to strongly hold the cover lid 7 against external force. However, such would cause difficulty for manual opening operation of the cover lid.

FIG. 7 shows the other conventional structure. As shown in FIG. 7, a leaf spring 27 is disposed inside a casing 24. A rod member 23 is disposed through a sidewall of the casing 24, and operates to apply a biasing or pressing force caused by the leaf spring 27 to a hinge portion of a cover lid 25 to open the cover lid 25 around a shaft 26.

However, the FIG. 7 conventional structure of opening and closing a cover lid has drawbacks such as a spacing is limited for positioning of the leaf spring, a shape there of is also limited and the pressing force of the leaf spring is fluctuated seriously.

SUMMARY OF THE INVENTION

In view of the above noted drawbacks, a first object of this invention is to ensure the firm locking of a cover lid without regard to magnitude of external force such as mechanical impact applied to the cover lid in order to eliminate the noted drawback of the FIG. 2 prior art.

In order to achieve the first object, according to first aspect of the present invention, in the structure for opening and closing of a cover lid which would receive a hard impact in exercise such as swimming, a cover lid locking button (hereinafter, referred to as "lock button") is formed at its head portion with a recess. The lock button is disposed through a side wall of a casing with a water-tight sealing and a coil spring while holding an end of the lock button shaft with a stopper ring inside the casing. A cover lid is formed with a protrusion for locking. When manually closing the cover lid, the protrusion comes into engagement with the recess formed on the head of the lock button while the lock button is sliding against bias force of the coil spring according to the manual pressing force applied to the closing cover lid. An engagement or coupling amount is maintained between the protrusion and the recess 14 the biasing force of the coil spring disposed around the lock button to thereby prevent inadvertent unlocking of the cover lid.

In the above constructed mechanism for preventing inadvertent unlocking of the cover lid, the protrusion formed on the cover lid comes into engagement with the recess formed on the head portion of the lock button by the given coupling amount so as to eliminate inadvertent unlocking of the cover lid to ensure the film locking state.

In order to realize the second object, according to second aspect of the present invention, the FIG. 7 conventional leaf spring is replaced by another coil spring to produce a stable pressing force of the rod member.

In the above described inventive structure, stable opening and closing movement of the cover lid is effected, and it is not necessary to limit a shape and construction of the casing.

DETAILED DESCRIPTION OF EMBODIMENTS

Figure 1:
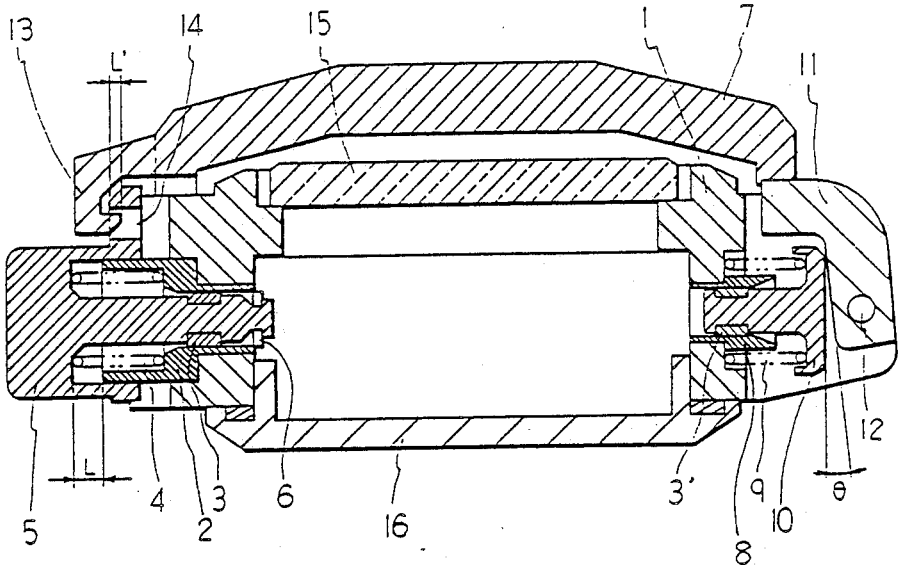
FIG. 1 is a vertical section of a first embodiment of the inventive watch.
Figure 2:
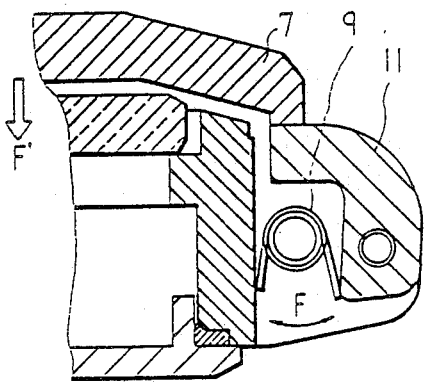
FIG. 2 PRIOR ART
FIG. 2 is a vertical section of the conventional watch.
Figure 5:
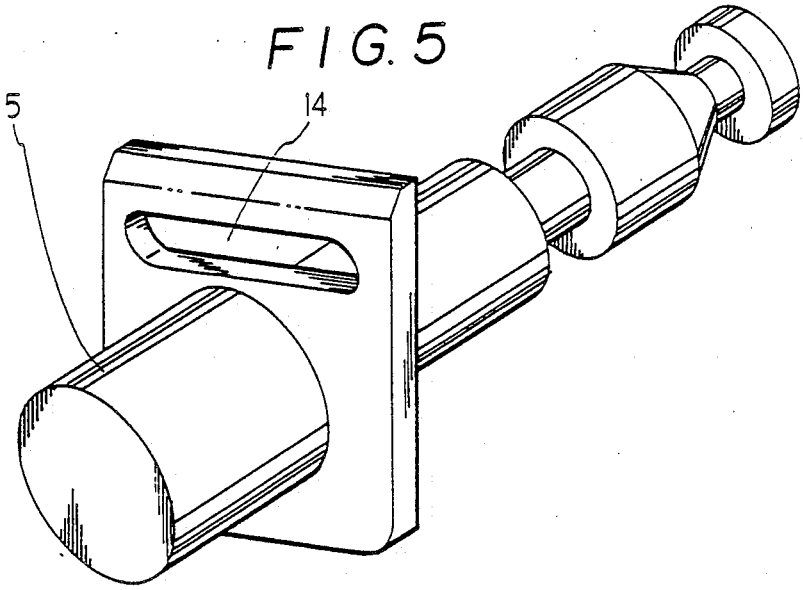
FIG. 5 is a perspective view of a lock button used in the FIG. 1 embodiment.

Hereinafter, preferred embodiments of this invention are described in conjunction with the drawings. Referring to FIG. 1 which shows a first embodiment, a button pipe 2 is fixed through one side of a casing 1. A lock button 5 is slideably inserted into the button pipe 2 through a displacement distance L with a water-tight sealing 3 and a coil spring 4, and is held at its end portion with a stopper ring 6. Another pipe 8 is fixed through an opposite side of the casing 1. A transmission pin 10 is slideably inserted into the pipe 8 through another water-tight sealing 3' and another coil spring 9. A hinge 11 is disposed to undergo pivoting movement or opening and closing movement around a shaft 12 by an angle $\theta$ in response to reciprocating movement of the transmission pin 10. FIG. 5 shows an overall shape of the lock button. The watch further includes a cover glass 15 and a back lid 16.

Figure 3:
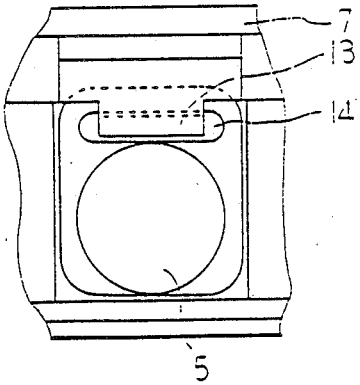
FIG. 3 is a partial side view of the first embodiment.
Figure 4:
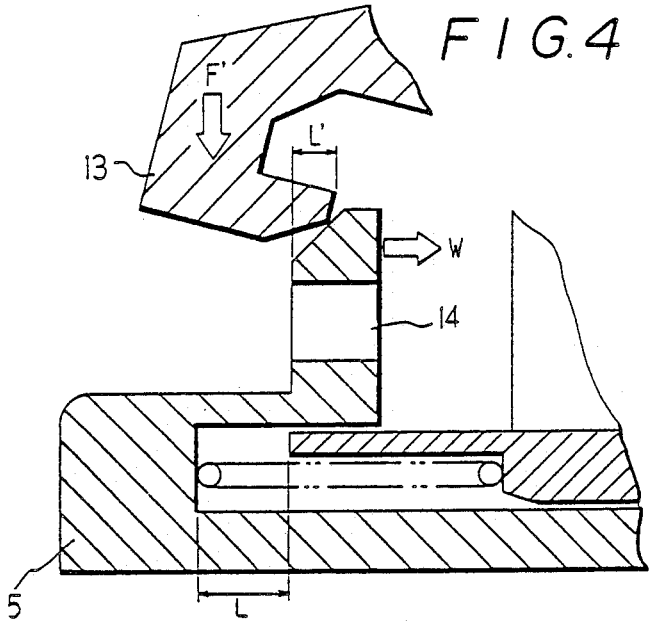
FIG. 4 is an illustrative view showing locking operation of the first embodiment.

Referring to FIG. 4, in operation, a protrusion 13 formed on the cover lid 7 is brought over a recess 14 formed on the head of the lock button 5 when the cover lid 7 is returned from the open state for locking operation. When the manual force F' is applied downward to close the cover lid 7, the protrusion 13 formed on the cover lid 7 presses a slanting front face of the head of the lock button 5 above the recess 14 so as to slide inward the lock button 5 in the direction W against the biasing force of the coil spring 4 by the locking amount L' which is smaller than the stroke L. The cover lid 7 is pressed down into the locking state. FIG. 3 shows this locking state in which the protrusion 13 and the recess 14 are engaged with each other through the biasing force of the coil spring 4.

When unlocking the cover lid, the lock button 5 is pressed inward by a distance more than the locking amount L′ such that the protrusion is unlocked from the recess so that the transmission pin 10 acts on the hinge 11 to pivot the same around the shaft 12 in the opening direction by the angle $\theta$ through the coil spring 9 so as to open the cover lid 7.

In the first embodiment, the protrusion 13 of the cover lid 7 is brought into engagement with the recess 14 formed on the head portion of the lock button 5 by the locking amount L′ to avoid inadvertent opening of the cover lid so as to effect firm locking function against a hard impact which would be caused by exercise of the wearer such as swimming.

As described above, according to first aspect of the invention, the lock button is utilized to avoid inadvertent opening of the cover lid under condition in which strong impact is imposed on the cover lid during exercise such as swimming, thereby preventing destruction of cover lid and cover glass and realizing a safe construction of the watch casing with cover lid.

Figure 6:
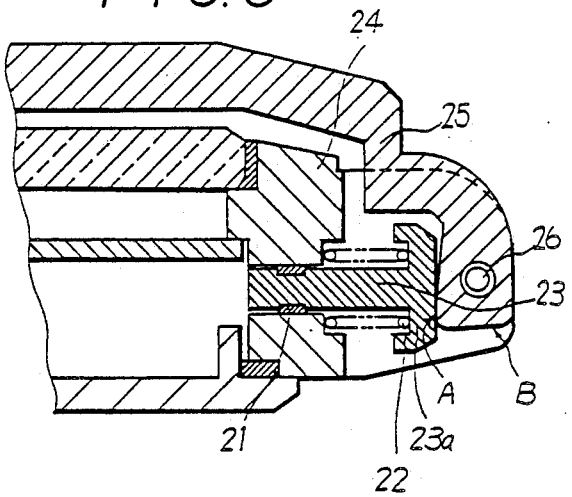
FIG. 6 is a partial sectional view of a second embodiment according to the invention.
Figure 7:
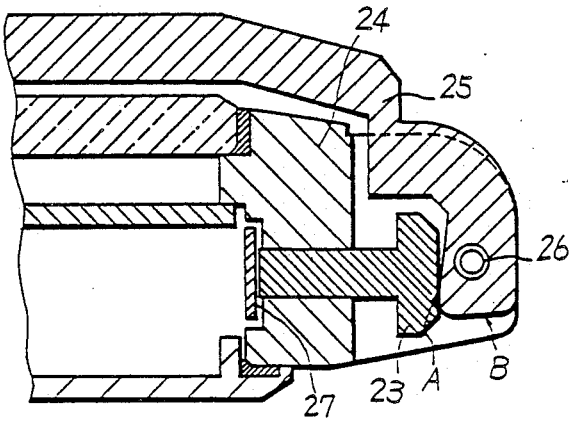
FIG. 7 PRIOR ART
FIG. 7 is a sectional view of the other conventional cover lid opening and closing mechanism.

Hereinafter, a second embodiment of the present invention is described in conjunction with the drawings. Referring to FIG. 6, the inventive structure includes a water-tight sealing 21 having a sufficient thickness for tight sealing, a coil spring 22 and a rod member 23 having a head 23*a*. The rod member 23 is slideably inserted into a hole formed through a casing 24 of the watch and is supported by the water-tight sealing 21. The coil spring 22 is disposed around the rod member 3 between an outer side of the casing 24 and the head 23*a*. A cover lid 25 is disposed on the casing 24 pivotably around a shaft 26 to constitute hinge coupling.

In opening operation of the cover lid, the cover lid 25 is turned clockwise and the head 23*a* of the rod member comes into contact with a hinge part B of the cover lid 25 so as to press the rod member into the hole of the casing 24. In closing operation of the cover lid, the head 23*a* of the rod member comes into contact with another hinge part A of the cover lid 25.

As described above, according to the second aspect of this invention, the casing is constructed such that a coil spring is utilized to bias the rod member to effect stable movement of the rod member to thereby carry out stable opening and closing of a cover lid and to thereby stably bias the cover lid in the closing direction.

What is claimed is:

1. In a watch having a casing and means for opening and closing a cover lid, the improvement comprising:

a button pipe fixed through one side of the casing;

a coil spring disposed in the button pipe;

a lock button disposed slideably through the button pipe and biased outward by means of the coil spring and having a recess;

another pipe fixed through an opposite side of the casing;

a transmission pin slideably disposed and biased outward in said another pipe;

a hinge for undergoing opening movement in response to sliding movement of the biased transmission pin; and a cover lid having one end portion supported by the hinge and another end portion which has a protrusion engageable with the recess of the lock button.

2. In a watch having a casing and a mechanism for opening and closing a cover lid, the improvement comprising: cover lid having a hinge portion supported pivotably on a casing of the timepiece;

means defining a hole through a sidewall of the casing;

a rod member disposed slideably and water-tightly in the hole and having a head which can be brought into engagement with the hinge portion of the cover lid; and a coil spring disposed around the rod member between an outer face of the sidewall of the casing and the head so as to enable the rod member to press the cover lid in closing direction.

* * * * *